US010332334B2

(12) United States Patent
Bolling, Jr. et al.

(10) Patent No.: US 10,332,334 B2
(45) Date of Patent: Jun. 25, 2019

(54) METHOD OF GAMING, GAMING SYSTEM AND GAME CONTROLLER THAT MODIFY REEL STRIPS BY ADDING SYMBOL STACKS TO SYMBOLS PREDEFINED FOR THE REEL STRIPS

(71) Applicant: Aristocrat Technologies Australia Pty Limited, North Ryde (AU)

(72) Inventors: T. Grant Bolling, Jr., Maryland Heights, MO (US); Kurt Larsen, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 29 days.

(21) Appl. No.: 15/275,079

(22) Filed: Sep. 23, 2016

(65) Prior Publication Data

US 2017/0092049 A1 Mar. 30, 2017

Related U.S. Application Data

(60) Provisional application No. 62/232,726, filed on Sep. 25, 2015.

(51) Int. Cl.
*G07F 17/32* (2006.01)
*G07F 17/34* (2006.01)

(52) U.S. Cl.
CPC ..... *G07F 17/3213* (2013.01); *G07F 17/3209* (2013.01); *G07F 17/3225* (2013.01); *G07F 17/3246* (2013.01); *G07F 17/3251* (2013.01); *G07F 17/34* (2013.01)

(58) Field of Classification Search
CPC ..... G07F 17/326; G07F 17/3225; G07F 17/3265; G07F 17/3267; G07F 17/34
See application file for complete search history.

(56) References Cited

U.S. PATENT DOCUMENTS 6,544,120 B2 * 4/2003 Ainsworth ..... G07F 17/3244 273/138.2
7,252,591 B2 * 8/2007 Van Asdale ..... G07F 17/32 463/20
8,096,869 B2 1/2012 Yoshimi
(Continued)

FOREIGN PATENT DOCUMENTS

WO 2003045520 6/2003
WO 2007029405 A1 3/2007

*Primary Examiner* — David Duffy
(74) *Attorney, Agent, or Firm* — McAndrews, Held & Malloy, Ltd.

(57) ABSTRACT

An electronic method of operating a gaming system comprising a game controller. The method comprises forming, using the game controller, at least one dynamically generated reel strip by a) conducting a random determination to select one of a plurality of different arrangements of a defined number of stacked symbols, each arrangement dividing the defined number of stacked symbols into a different number of stacks of the symbol, and b) adding the selected arrangement to symbols predefined for the respective reel strip; selecting symbols, using the game controller, from a set of reel strips including the at least one dynamically generated reel strip; displaying the selected symbols on the display; and making, using the game controller, an award if the selected symbols include one or more winning outcomes.

20 Claims, 9 Drawing Sheets

901

| Weights for Height and Stacks | | |
|---|---|---|
| Reel Height | # Stacks | Weight |
| 5 | 6 | 1 |
| 5 | 4 | 2 |
| 5 | 3 | 2 |
| 5 | 2 | 2 |
| 6 | 6 | 2 |
| 6 | 4 | 2 |
| 6 | 3 | 2 |
| 6 | 2 | 2 |
| 7 | 6 | 2 |
| 7 | 4 | 2 |
| 7 | 3 | 4 |
| 7 | 2 | 2 |
| 8 | 6 | 2 |
| 8 | 4 | 2 |
| 8 | 3 | 2 |
| 8 | 2 | 2 |

(56) References Cited

U.S. PATENT DOCUMENTS 8,287,358 B2 * 10/2012 Aoki ..... G07F 17/34 463/16
8,366,540 B2 2/2013 Yoshimi
8,602,868 B2 * 12/2013 Johnson ..... G07F 17/3213 463/20
8,616,955 B2 12/2013 Yoshimi
8,622,810 B2 1/2014 Yoshimi
8,628,401 B2 1/2014 Yoshimi
8,641,508 B2 2/2014 Yoshimi
8,795,059 B2 * 8/2014 Aoki ..... G07F 17/32 463/20
9,098,982 B2 * 8/2015 Mastropietro ..... G07F 17/34
9,199,162 B2 12/2015 Yoshimi
9,208,655 B2 12/2015 Aida
9,214,066 B2 * 12/2015 Collette ..... G07F 17/326
9,230,401 B2 * 1/2016 O'Halloran ..... G07F 17/3244
9,330,527 B2 * 5/2016 Collette ..... G07F 17/326
9,361,763 B1 * 6/2016 Aoki ..... G07F 17/326
9,483,900 B2 * 11/2016 Aoki ..... G07F 17/32
9,520,016 B2 12/2016 Delkta
9,619,960 B2 4/2017 Yoshimi
9,652,933 B2 * 5/2017 Johnson ..... G07F 17/3244
9,792,774 B2 10/2017 Rucker
9,799,172 B2 10/2017 Rucker
9,805,556 B2 * 10/2017 Lee ..... G07F 17/326
2004/0023714 A1 * 2/2004 Asdale ..... G07F 17/32 463/22
2005/0079911 A1 4/2005 Nakatsu
2006/0183534 A1 8/2006 Yoshimi
2012/0115570 A1 * 5/2012 Collette ..... G07F 17/326 463/20
2012/0309498 A1 * 12/2012 O'Halloran ..... G07F 17/3244 463/20
2013/0065663 A1 * 3/2013 Johnson ..... G07F 17/3213 463/20
2013/0079105 A1 3/2013 Yoshimi
2013/0102375 A1 * 4/2013 Aoki ..... G07F 17/32 463/20
2014/0066173 A1 3/2014 Yoshimi
2014/0135096 A1 5/2014 Aida et al.
2014/0274282 A1 * 9/2014 Mastropietro ..... G07F 17/34 463/20
2015/0279166 A1 * 10/2015 Mastropietro ..... G07F 17/34 463/20
2015/0379828 A1 * 12/2015 Lee ..... G07F 17/34 463/20
2015/0379829 A1 * 12/2015 Lee ..... G07F 17/34 463/20
2015/0379830 A1 * 12/2015 Lee ..... G07F 17/34 463/20
2015/0379831 A1 * 12/2015 Lee ..... G07F 17/34 463/20
2016/0063806 A1 * 3/2016 Collette ..... G07F 17/326 463/21
2016/0078713 A1 3/2016 Gilmore
2016/0232755 A1 * 8/2016 Collette ..... G07F 17/326

* cited by examiner

901

| Weights for Height and Stacks | | |
|---|---|---|
| Reel Height | # Stacks | Weight |
| 5 | 6 | 1 |
| 5 | 4 | 2 |
| 5 | 3 | 2 |
| 5 | 2 | 2 |
| 6 | 6 | 2 |
| 6 | 4 | 2 |
| 6 | 3 | 2 |
| 6 | 2 | 2 |
| 7 | 6 | 2 |
| 7 | 4 | 2 |
| 7 | 3 | 4 |
| 7 | 2 | 2 |
| 8 | 6 | 2 |
| 8 | 4 | 2 |
| 8 | 3 | 2 |
| 8 | 2 | 2 |

FIGURE 9

1001

1005

| Key for symbols inserted | |
|---|---|
| Number | Symbol |
| 0 | Wild |
| 1 | Batgirl |
| 2 | Catwoman |
| 3 | Robin |
| 4 | Alfred |
| 5 | Chief |
| 6 | Thug |
| 7 | Radio |
| 8 | Gun |
| 9 | Mask |

1003

1003

FIGURE 10

METHOD OF GAMING, GAMING SYSTEM AND GAME CONTROLLER THAT MODIFY REEL STRIPS BY ADDING SYMBOL STACKS TO SYMBOLS PREDEFINED FOR THE REEL STRIPS

RELATED APPLICATIONS

This application claims priority to U.S. Provisional Patent Application No. 62/232,726 having a filing date of Sep. 25, 2015, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming systems are known that employ stacks of symbols—i.e. groups of the same symbol arranged at contiguous symbol positions on a reel strip.

A need exists for alternative gaming systems.

BRIEF SUMMARY OF THE INVENTION

In a first aspect, the invention provides an electronic method of operating a gaming system comprising a game controller, the method comprising:

forming, using the game controller, at least one dynamically generated reel strip by a) conducting a random determination to select one of a plurality of different arrangements of a defined number of stacked symbols, each arrangement dividing the defined number of stacked symbols into a different number of stacks of the symbol, and b) adding the selected arrangement to symbols predefined for the respective reel strip;

selecting symbols, using the game controller, from a set of reel strips including the at least one dynamically generated reel strip;

displaying the selected symbols on the display; and making, using the game controller, an award if the selected symbols include one or more winning outcomes.

In an embodiment, the method comprises conducting a random determination to select a symbol for the stacks of each dynamically generated reel strip for a set of stack symbols.

In an embodiment, the method comprises forming dynamically generated reel strips for each of the reel strips.

In an embodiment, the random determination from the set of stack symbols is performed independently for each reel strip such that different symbols of the set of stack symbols may be selected for each of the reel strips.

In an embodiment, at least one of the winning outcomes requires the portions of the active game area corresponding to respective ones of a defined number of the reel strips to be filled by symbols of a stack of symbols.

In an embodiment, the defined number of reel strips is all of the reel strips.

In an embodiment, the method comprises selecting, using the game controller, a height for an active game area from one of a plurality of different heights of symbol display positions, and wherein said selecting symbols comprises selecting sufficient symbols to populate the active game area for the current height.

In an embodiment, at least some of the different heights are associated with different awards for filling the portions of the active game area corresponding to respective ones of a defined number of the reel strips with symbols of a stack of symbols.

In an embodiment, the method comprises selecting the height of the active game area in conjunction with conducting the random determination to select one of a plurality of different arrangements of a defined number of stacked symbols.

In an embodiment, the random determination is performed using a weighted table that defines different combinations of arrangements of stacked symbols and heights of the active game area.

In a second aspect, the invention provides an electronic gaming system comprising:

a display; and a game controller configured to:

form at least one dynamically generated reel strip by a) conducting a random determination to select one of a plurality of different arrangements of a defined number of stacked symbols, each arrangement dividing the defined number of stacked symbols into a different number of stacks of the symbol, and b) adding the selected arrangement to symbols predefined for the respective reel strip;

select from a set of reel strips including the at least one dynamically generated reel strip;

control the display to display the selected symbols; and make an award if the selected symbols include one or more winning outcomes.

In a third aspect, the invention provides an electronic game controller for a gaming system comprising a display, the game controller comprising:

a reel strip former configured to form at least one dynamically generated reel strip by a) conducting a random determination to select one of a plurality of different arrangements of a defined number of stacked symbols, each arrangement dividing the defined number of stacked symbols into a different number of stacks of the symbol, and b) adding the selected arrangement to symbols predefined for the respective reel strip;

a symbol selector configured to select symbols, using the game controller, from a set of reel strips including the at least one dynamically generated reel strip;

a display controller configured to control the display to display the selected symbols; and an outcome evaluator configured to make an award if the selected symbols include one or more winning outcomes.

In a fourth aspect, the invention provides an electronic method of operating a gaming system comprising a display and a game controller, the method comprising:

selecting, using the game controller, a height for an active game area from one of a plurality of different heights of symbol display positions, wherein at least some of the different heights are associated with different awards;

selecting, using the game controller, symbols from a plurality of reel strips to populate the active game area for the current height, each reel strip comprising at least one stack of symbols, each symbol of a respective stack being the same;

displaying the selected symbols in active game area on the display; and making, using the game controller, an award associated with the current height when the portions of the active game area corresponding to respective ones of a defined number of the reel strips are filled by symbols of a stack of symbols.

In an embodiment, the defined number of reel strips is all of the reel strips.

In an embodiment, each reel strip comprises at least one stack of symbols having the same length in symbol display positions as the highest possible height of the active game area.

In an embodiment, the lengths of the stacks of symbols are dynamically selected from a set of possible lengths.

In an embodiment, the smallest possible length of the stacks of symbols corresponds to the highest possible height of the active game area.

In an embodiment, the method comprises selecting lengths of the stacks of symbols and the height of the active display area from a weighted table that defines different combinations of lengths of stacked symbols and heights of the active game area.

In a fifth aspect, the invention provides a gaming system comprising:

a display; and a game controller configured to:

select a height for an active game area from one of a plurality of different heights of symbol display positions, wherein at least some of the different heights are associated with different awards;

select symbols from a plurality of reel strips to populate the active game area for the current height, each reel strip comprising at least one stack of symbols, each symbol of a respective stack being the same;

control the display to display the selected symbols in active game area; and make the award associated with the current height when the portions of the active game area corresponding to respective ones of a defined number of the reel strips are filled by symbols of a stack of symbols.

In a sixth aspect, the invention provides an electronic game controller comprising:

a height selector configured to select a height for an active game area from one of a plurality of different heights of symbol display positions, wherein at least some of the different heights are associated with different awards;

a symbol selector configured to select symbols from a plurality of reel strips to populate the active game area for the current height, each reel strip comprising at least one stack of symbols, each symbol of a respective stack being the same;

a display controller configured to control the display to display the selected symbols in active game area; and an outcome evaluator configured to make the award associated with the current height when the portions of the active game area corresponding to respective ones of a defined number of the reel strips are filled by symbols of a stack of symbols.

In a seventh aspect, the invention provides computer program code which when executed implements the above method.

In an eighth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which:

FIG. 9 is a table for selection of heights and stacks; and

FIG. 10 is table for selection of symbols.

DETAILED DESCRIPTION OF THE INVENTION

Figure 1:
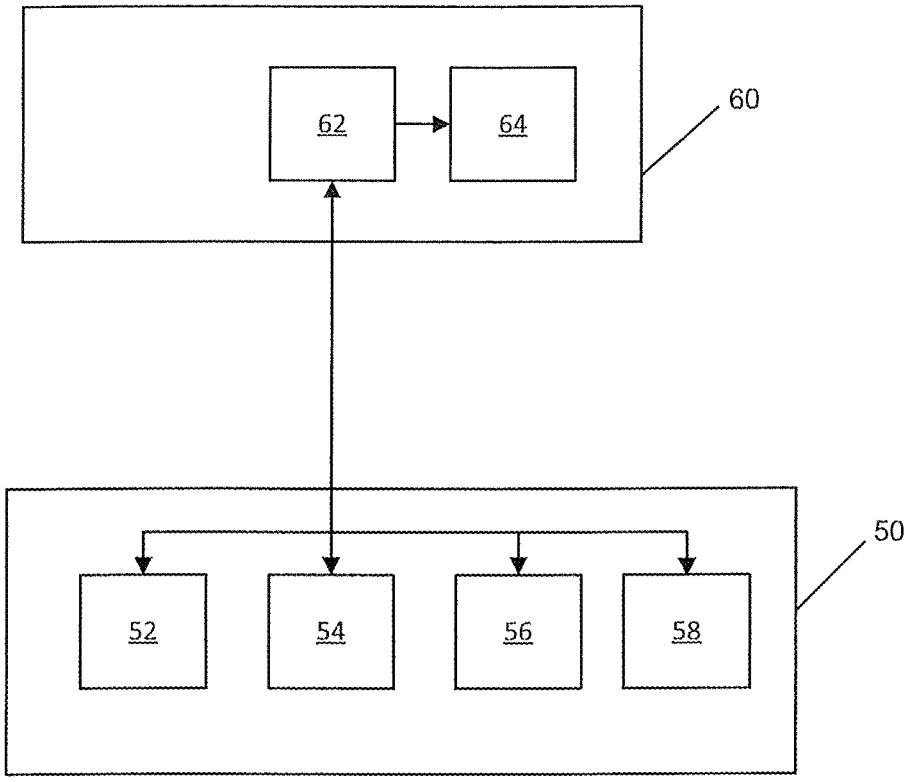
FIG. 1 is a block diagram of the core components of a gaming system.

Referring to the drawings, there is shown a gaming system having a game controller having components that enable the implementation of a method of operating a gaming system where, in an embodiment, one or more reel strips (advantageously all of the reel strips) are dynamically formed by adding stacked symbols having predefined symbols. In the embodiment, there are different arrangements of the stacked symbols where the stacked symbols are divided into stacks of different lengths. In an embodiment, symbols are selected for display in an active display area which has a height in symbol display positions which is randomly determined from a set of possible heights. In an embodiment, different heights are associated with different awards that are won when stacks of symbols fill the active display area. In an advantageous embodiment, a combination of stacks of different symbols in different columns of the symbol display area can fill the active display area.

In advantageous embodiments both the length of the stacks and the height of display area are randomly determined so as to vary the probability of an award being made. In an advantageous embodiment, a weighted table defines combinations of lengths of the reel strips and the height of the symbol display area.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is configured to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface 50 and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
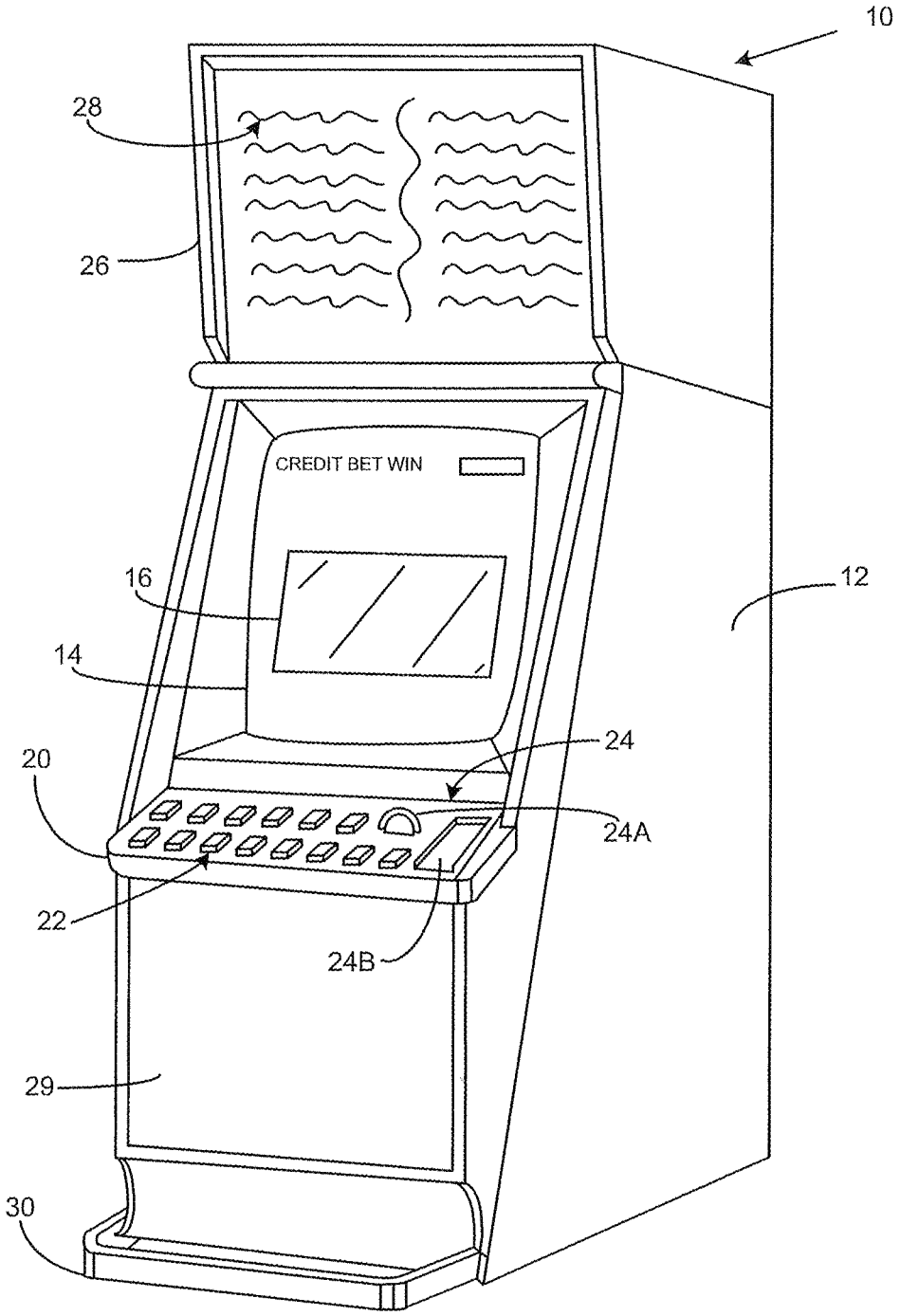
FIG. 2 is a perspective view of a standalone gaming machine.

A gaming system in the form of a stand lone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed which may receive physical items other than coins or bills, for example, a Card reader for reading a smart card, debit card or credit card. Likewise, other credit input mechanisms may be employed for receiving tickets such that a ticket reader reads tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module that is accessed in response to insertion of the player tracking device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. The display 14 may any other suitable video display unit, such as an OLED display. The top box 26 may also include a display, which may be of the same type as the display 14, or of a different type.

Figure 3:
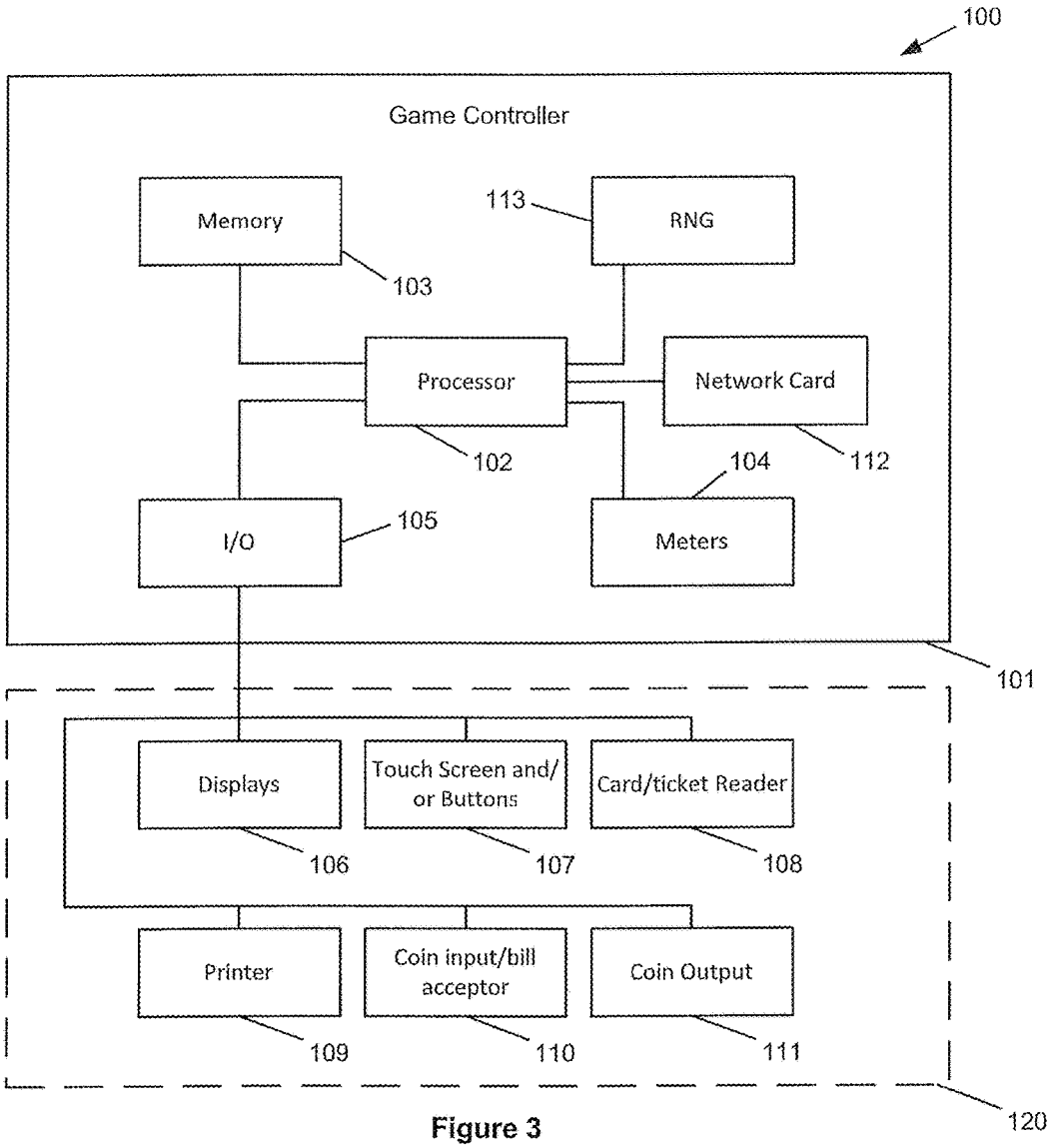
FIG. 3 is a block diagram of the functional components of a gaming machine.

FIG. 3 shows a block diagram of operative components of a typical gaming machine which may be the same as or different than the components of the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, and an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and an output mechanism 111 (which causes output of coins via coin tray 30 or output of a ticket via printer 109, and the like). Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine. The network card may provide value output information, as well, such as credits or currency information.

Figure 4:
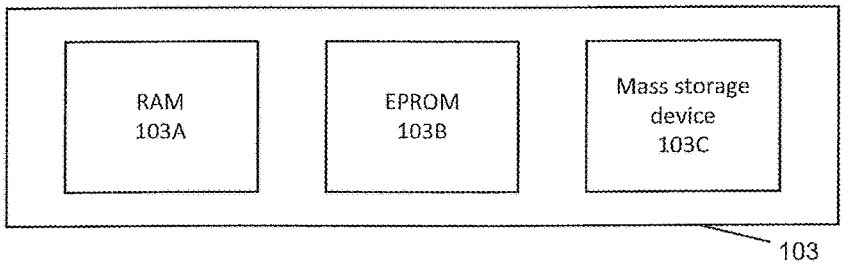
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
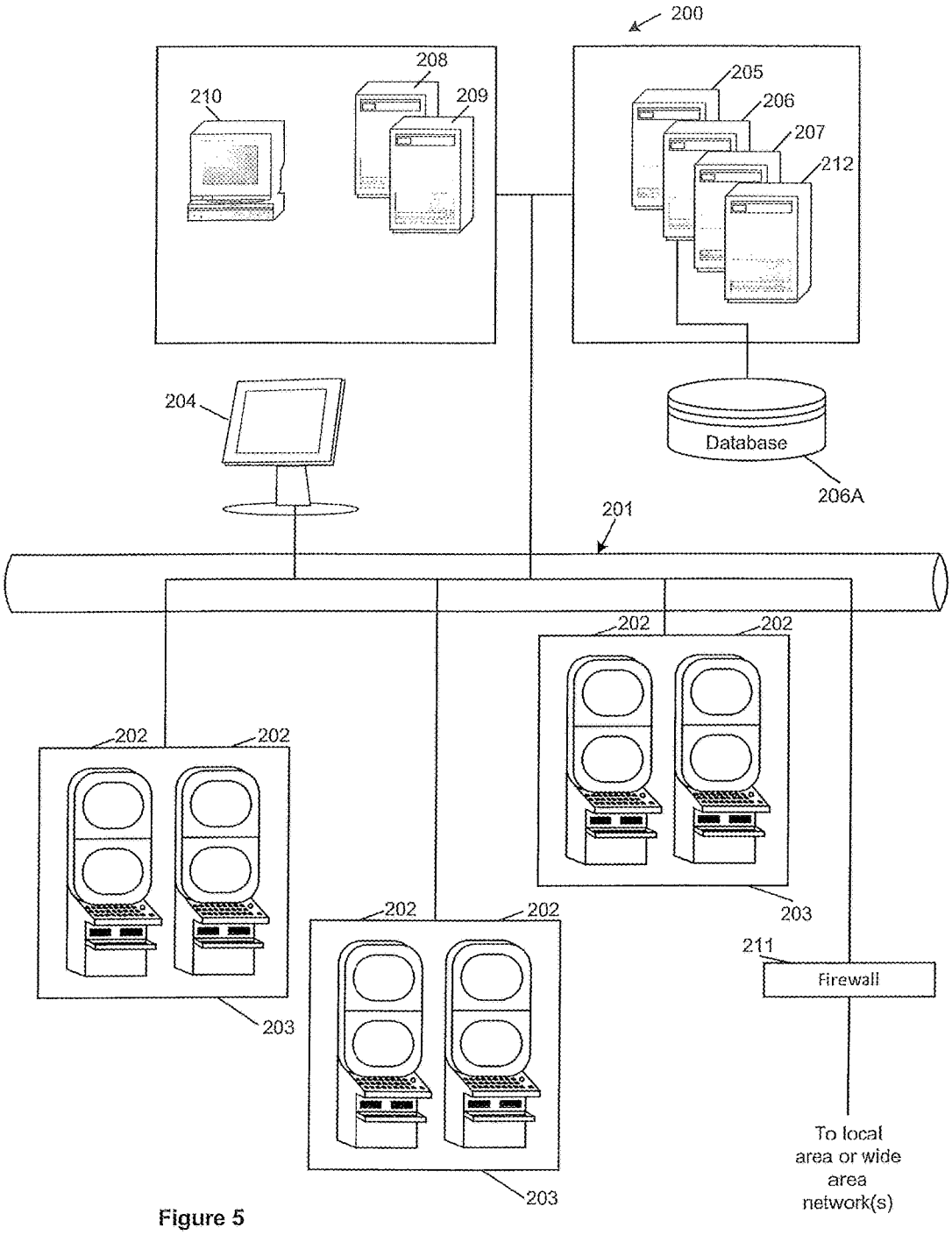
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Details of the Gaming System

The player operates the game play mechanism 56 (FIG. 1) to specify a wager which will be evaluated for this play of the game in accord with credit input made via credit input mechanism 52 which may establish a credit balance. The credit balance may increase and decrease based on wager input, awards of the game, etc. Game play mechanism 56 is also operated by the player to and initiate a play of the game. Persons skilled in the art will appreciate that a player's wager can be varied from game to game dependent on player selections. In most spinning reel games, it is typical for the player's wager to be made up of a selection as to how the game outcome will be evaluated by specifying what parts of the game outcome will qualify for winning outcomes and a multiplier that will apply to each winning outcome. For example, a player's wager may be based on how many lines the player plays in each game—e.g. a minimum of one line up to the maximum number of lines allowed by the game (noting that not all permutations of win lines may be available for selection) and an amount per line—e.g. one, two or five credits. Winning outcomes on an activated win line may be evaluated based on a pay table that specifies the amount awarded for a one credit per line wager multiplied by the amount wagered per line.

Such win lines are typically formed by a combination of symbol display positions, one from each reel, the symbol display positions being located relative to one another such that they form a line.

In many games, the gaming machine may award winning outcomes which are not strictly limited to the lines they have selected, for example, "scatter" pays are awarded independently of a player's selection of pay lines.

Persons skilled in the art will appreciate that in other embodiments, the player may select a number of reels to play. Games of this type are marketed under the trade name "Reel Power" by Aristocrat Leisure Industries Pty Ltd and are also known as "ways" to win games. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the center row are used for non-selected reels. As a result, the total number of ways to win is determined by multiplying the number of active display positions of each of the reels, the active display positions being all display positions of each selected reel and the designated display position of the non-selected reels. As a result, for five reels and fifteen display positions there are 243 ways to win.

Figure 6:
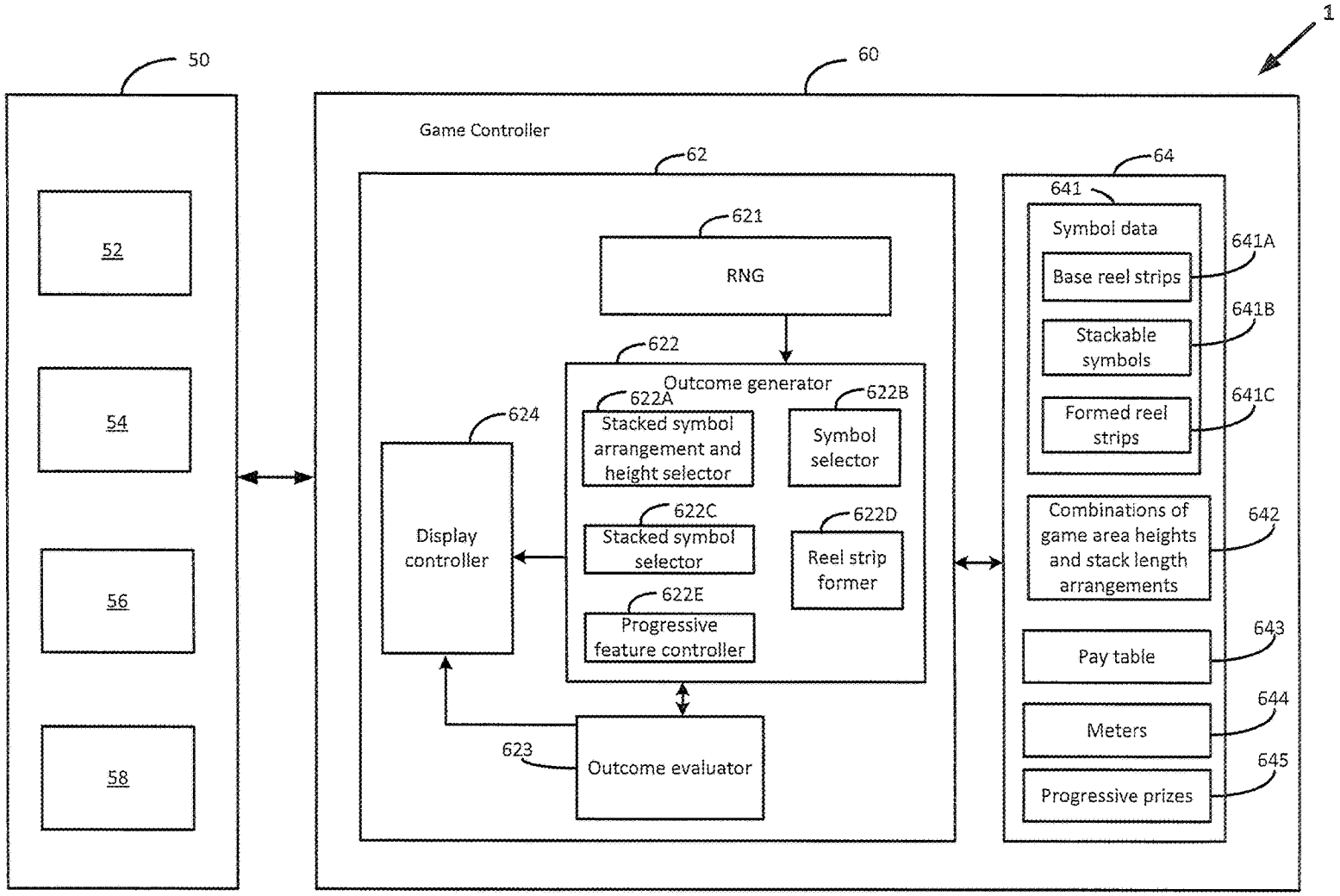
FIG. 6 is a further block diagram of a gaming system.

In FIG. 6, the processor 62 of game controller 60 is shown implementing a number of modules based on program code and data stored in memory 64. Persons skilled in the art will appreciate that one or more of the modules could be implemented in some other way, for example by a dedicated circuit.

The outcome generator 622 is configured to form reel strips dynamically during each play of the game by determining an arrangement of stacks of symbols to be added to predefined base reel strips. That is, each time a player places a fresh wager, one or more reel strips are dynamically formed by adding stacks of symbols to base reel strips. In this embodiment, the outcome generator 622 is also configured to determine a height for the displayed game play area that will be active in a current game. In the embodiment, the height of the displayed game area (in terms of the number of rows of symbols displayed) and the length of stacks (in terms of the number of symbols in a stack) are selected from a single, co-dependent weighted table in order to allow design of a game in which occurrences of long stacks and increases in game height both occur relatively frequently. To this end, the outcome generator 622 includes a stacked symbol arrangement and height selector 622A which selects one of a combination of game area heights (e.g., in terms of rows in an array) and stack length arrangements (e.g., in terms of the number of symbols in the stack) from a weighted table 642.

In this embodiment, the game area defines the number of symbol display positions that will be displayed in a particular play of the game on display 54. The game play area has a number of columns corresponding to respective ones of a plurality of reel strips. In one example, shown in FIG. 8A, there are five columns of symbol display positions 821, 822, 823, 824 and 825. The symbol display positions are arranged in a rectangular array (a 5×5 array) with five rows of symbol display positions. This is one example of a lowest number of rows, as shown in FIG. 8A. Accordingly, it will be appreciated that if there are five rows, the height of the active game area is five symbol positions high.

In one example, shown in FIGS. 8A to 8D there are four possible different heights of the active game play area, i.e., five symbol positions high, six symbol positions high, seven symbol positions high and eight symbol positions high, shown in FIGS. 8A to 8D respectively. In one example, there are also four possible different arrangements of stacks. In the embodiment, each arrangement of stacks is formed by dividing a defined number of stacked symbols into different numbers of stacks of the symbol. In one example, there are forty-eight symbols that are added to each of the five reels in particular stack arrangements.

In this respect, symbol data 641 defines base reel strips 641A which are comprised of a number of predefined symbols (e.g., 35 symbols) to which arrangements of stacked symbols will be added. The base reel strips 641A also define the positions at which the stacks of symbols will be inserted, e.g., at any one of the reel positions, e.g., at 35 different locations between the 35 base symbols on a reel. Alternatively, the positions at which stacks may be inserted may be less than 35 and be predefined positions. In one example, 48 symbols are inserted into each reel and there are four possible arrangements of symbols: (1) two stacks which are 24 symbols long, (2) three stacks which are 16 symbols long, (3) four stacks which are 12 symbols long, and (4) six stacks which are 8 symbols long. In this example, while each stack arrangement of a specific reel will have the same number of stacked symbols, a different number of stacked symbols 641B may be selected for different reels. In this embodiment of the invention, the same arrangement of stacked symbols is applied to each reel.

The outcome generator has a stacked symbol selector 622C which obtains a number from random number generator 621 in order to select one (e.g., a Batman symbol) of a plurality of stackable symbols 641B (e.g., a Batman symbol, a Robin symbol a Batgirl symbol and a Catwoman symbol) to be added to the individual reels 821-825. The stackable symbols 641B are a subset of the base game symbols used during play of the game.

It will be appreciated that in an alternate embodiment, a single weighted table could be employed which defines not only the arrangement of stacks and the height of the game area but also which symbols will be added in stacks and into which reels.

In the embodiment, once the stacked symbol arrangement and height selector 622A has selected the stacked symbol arrangement and the active game area height, and the stacked symbol selector 622C has selected the stacked symbols for the respective reels, the reel strip former 622D combines these selections with a base reel strip 641A to form a reel strip 641C.

It will be appreciated that the particular approach of separately selecting stacked symbols for all of the reels allows for an advantageous award making technique in gaming systems of embodiments of the invention as described in further detail below. However, in other embodiments, less than all of the reels could have stacks of symbols added or the same symbol could be added to all of the reels.

Once the reel strips are formed, a symbol selector 622B selects symbols from the formed reel strips 641C using random number generator 621. The selected symbols are advised to the display controller 624 which causes them to be displayed on display 54 at a set of display positions.

One example of selecting symbols is for the symbol selector 622B to select symbols from the formed reel strips 641C corresponding to respective ones of a plurality of spinning reels. The formed reel strips 641C specify a sequence of symbols for each reel. In an embodiment, the symbol selector 622B selects the symbols for display by selecting a reel stopping position in the sequence. It is known to use a probability table stored in memory 64 to vary the odds of a particular reel stop position being selected. Other techniques can be used to control the odds of particular outcomes occurring to thereby control the return to player of the game.

Once symbols are selected (for display), they are evaluated in order to determine whether they include any winning outcomes. For example, in FIG. 8A, there is shown a winning combination 831 which is highlighted in the selected symbols. Another winning outcome 832 is highlighted in FIG. 8D. These evaluations are made by outcome evaluator 623 based on the pay table 643 which defines the winning outcomes and associated awards. In some embodiments, the outcome evaluator 623 also determines whether the active game area for the current height is completely populated by symbols from the stacks of symbols and makes an award of a progressive feature game as described in further detail below.

Figure 8B:
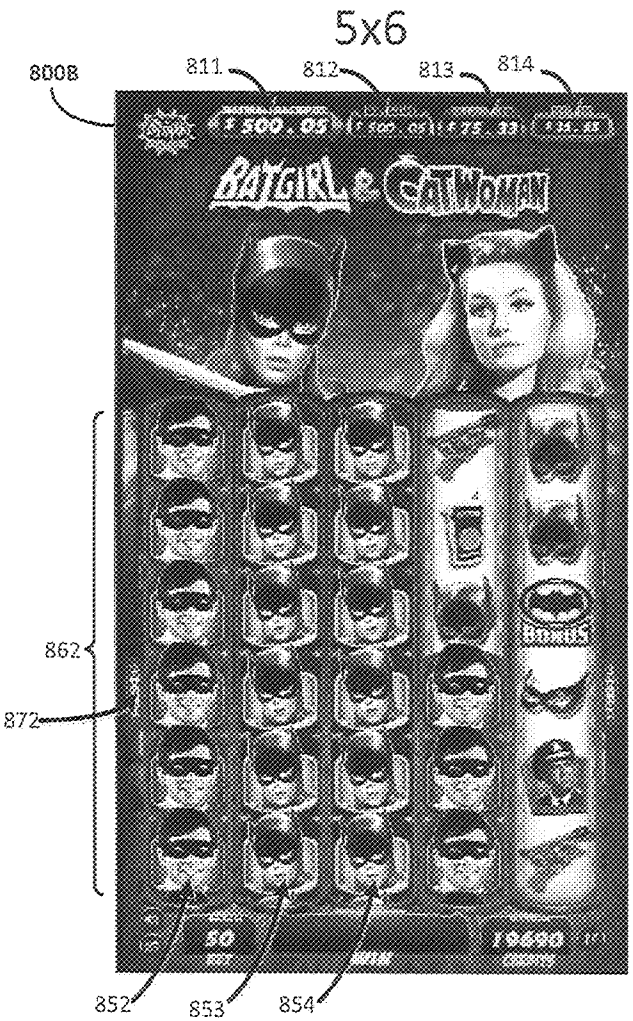
FIGS. 8A to 8D are exemplary screen shots showing how the game area changes.
Figure 8A:
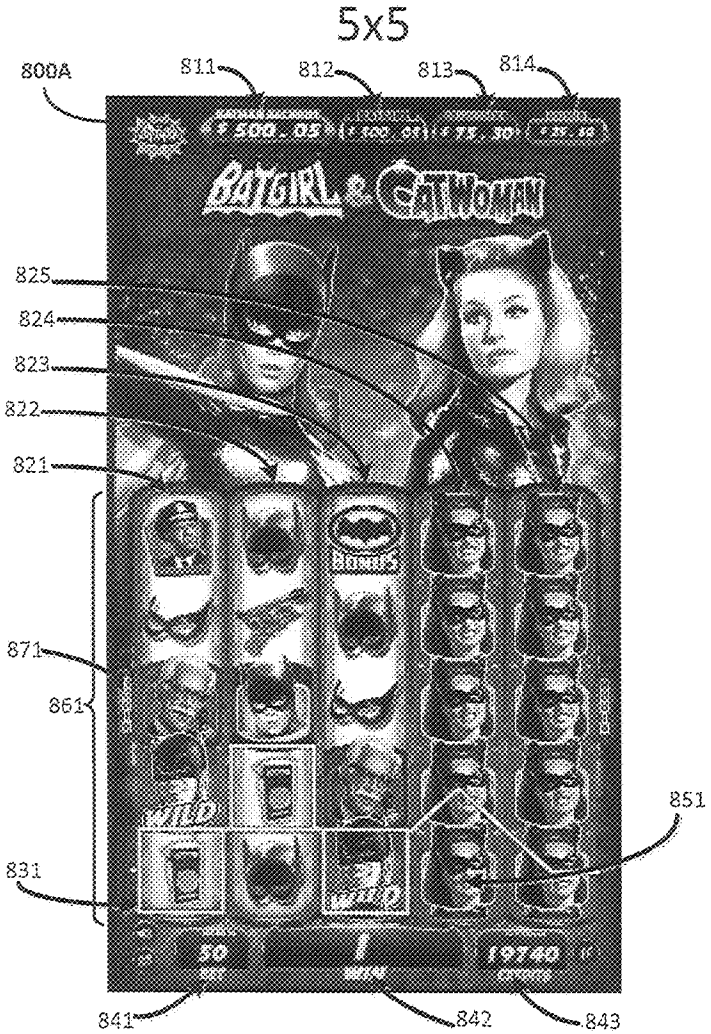
Figure 8D:
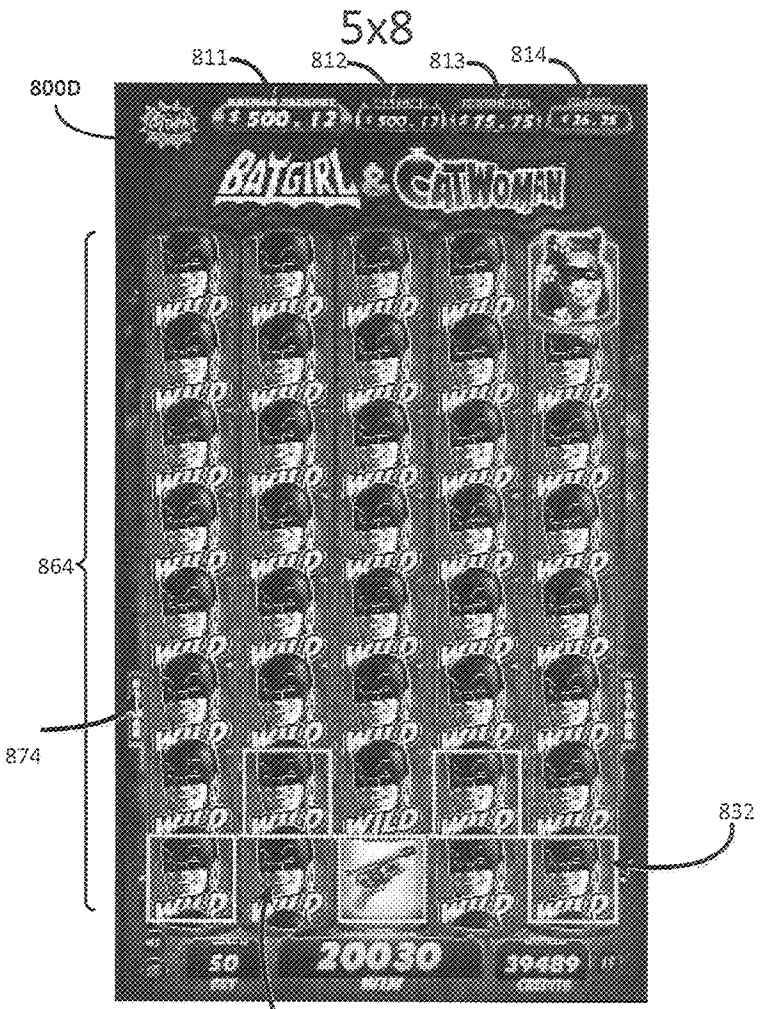
Figure 8C:
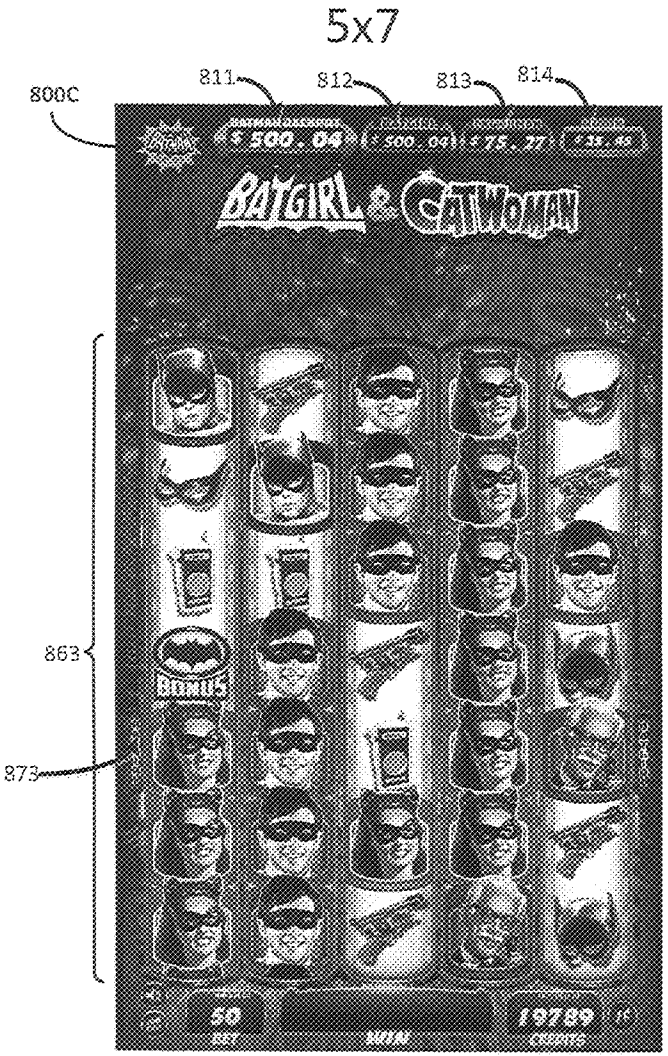

In this respect, referring to FIGS. 8A-8D there are shown a plurality of screen shots 800A to 800D of a game with the active game area in a number of different states. In each of the screen shots, the symbols are displayed in five columns 821, 822, 823, 824 and 825 of symbol display positions. FIGS. 8A-8D show four different heights of the active game play area. In FIG. 8A, the active game play area 861 is five symbol positions high. In FIG. 8B, the active game play area 862 is six symbol positions high. In FIG. 8C, the active game play area 863 is seven symbol positions high. In FIG. 8D, the active game play area 864 is eight symbol positions high.

In the example, there are four progressive jackpot prizes, a Batman jackpot 811, a Batgirl jackpot 812, a Catwoman jackpot 813, and a Robin jackpot 814. In the example, an award of a progressive feature from which these jackpots can be won is linked to the current height of the active game play area. Thus, the height of the active game area is part of an indication to which progressive jackpot is currently available.

In FIG. 8A, where the height is five symbols high, the Robin progressive jackpot 814 can be triggered as further indicated by the word Robin 871 being placed alongside the game play area. In FIG. 8B, the Catwoman progressive jackpot 813 is available as additionally indicated by the word Catwoman 872. In FIG. 8C, the Batgirl progressive jackpot 812 is available as additionally indicated by the message Batgirl 873. In FIG. 8D, the Batman progressive jackpot 811 is available as additionally indicated by the word Batman 874.

Thus, advantageously, the height of the active game play area 861-864 indicates the available progressive feature. While in this example, a separate progressive feature is carried out by the progressive feature controller 622E in order to determine whether to award a current value of the respective progressive jackpot prize 811-814, and hence this is what is awarded. In another embodiment, the progressive prize could be awarded directly without a feature game.

In this respect, in embodiments of the invention, the award criterion is that a defined number of columns of symbol display positions (advantageously all of the columns) are filled with a stack of symbols irrespective of whether different symbols provide the stack in different columns. For example, referring to FIG. 8B, it will be apparent that there is a stack 852 of Robin symbols filling the first column 821 and stacks 853, 854 of Batgirl symbols filling columns 822 and 823. Both Robin and Batgirl stacks count towards an award in embodiments of the invention, even though they are different. In other of the Figures, stacks of other stackable symbols such as Catwoman symbols 851 and Batman symbols 855 are shown filling an entire column.

As indicated above, in an advantageous embodiment of the invention, it is a requirement that all of the portions of the active game area that correspond to respective ones in different reels are filled with stacks of symbols for there to be an award by outcome evaluator 623, however, the individual symbols of different stacks may be different. In other embodiments, it may be sufficient that a smaller number of portions of the game play area are filled by stacks, for example, the three filled columns of the game play area shown in FIG. 8B or 8D.

It will be appreciated that the combination of the arrangement of stacked symbols in terms of their length and the height of the area controls the probability of a progressive feature award being made. For example, with an area height of eight rows, symbol stacks of 24 symbols are more likely to fill an entire column of the area array than a symbol stack of 8 symbols The stacks when added to the 35 base symbols are preferably spread apart as much as possible. With six stacks, a stack may be placed every six symbols except the last being placed after 5 symbols.

Referring again to FIG. 6, FIG. 6 shows that the progressive prizes 645 are stored in memory 64 of the gaming system. They are then awarded from the progressive feature by progressive feature controller 622E as described above. Any award of a prize is added to the meters 644. In this respect, FIGS. 8A to 8D show a bet meter 841, a win meter 842, and a credit meter 843. Typically, a win will be awarded to a win meter; however, in some embodiments, an award of above a certain size may be awarded directly to the credit meter to prevent it being used in any gamble feature that forms part of the game. In other embodiments, the progressive prizes could be part of a link game in which a number of different gaming machines compete to win the same prize. For example, a bank of four gaming machines may have a common link controller. The weight column in table 901 has a weight indicated at each of the 16 height/stack arrangements (although the grayed-out portions show a "2" as the weight merely for exemplary purposes).

The following table is an example different than FIG. 10 in which patterns and their weights are shown without use of numbers with symbol names.

| Symbol insertion: | | | | | |
|---|---|---|---|---|---|
| Reel 1 | Reel 2 | Reel 3 | Reel 4 | Reel 5 | Weight |
| R1 | Batgirl | R1 | Batgirl | R1 | 5 |
| R2 | R2 | Robin | Robin | Robin | 6 |
| R1 | R1 | R1 | R1 | Catwoman | 4 |
| R2 | R2 | R1 | R1 | Batman | 5 |

The table above shows, in its far right column, a total weight of 20 (5+6+4+5=20). Thus, the first row indicates a weight of 5 in the far right column, meaning that 5 out of 20, or 25% of the time, on any given spin it is likely that (as shown in row 1) symbol R1 will be inserted into reels 1, 3 and 5 while simultaneously "Batgirl" will be inserted into reels 2 and 4. As will suggest itself, other forms of tables may be used for weighted symbol insertion.

Figure 7:
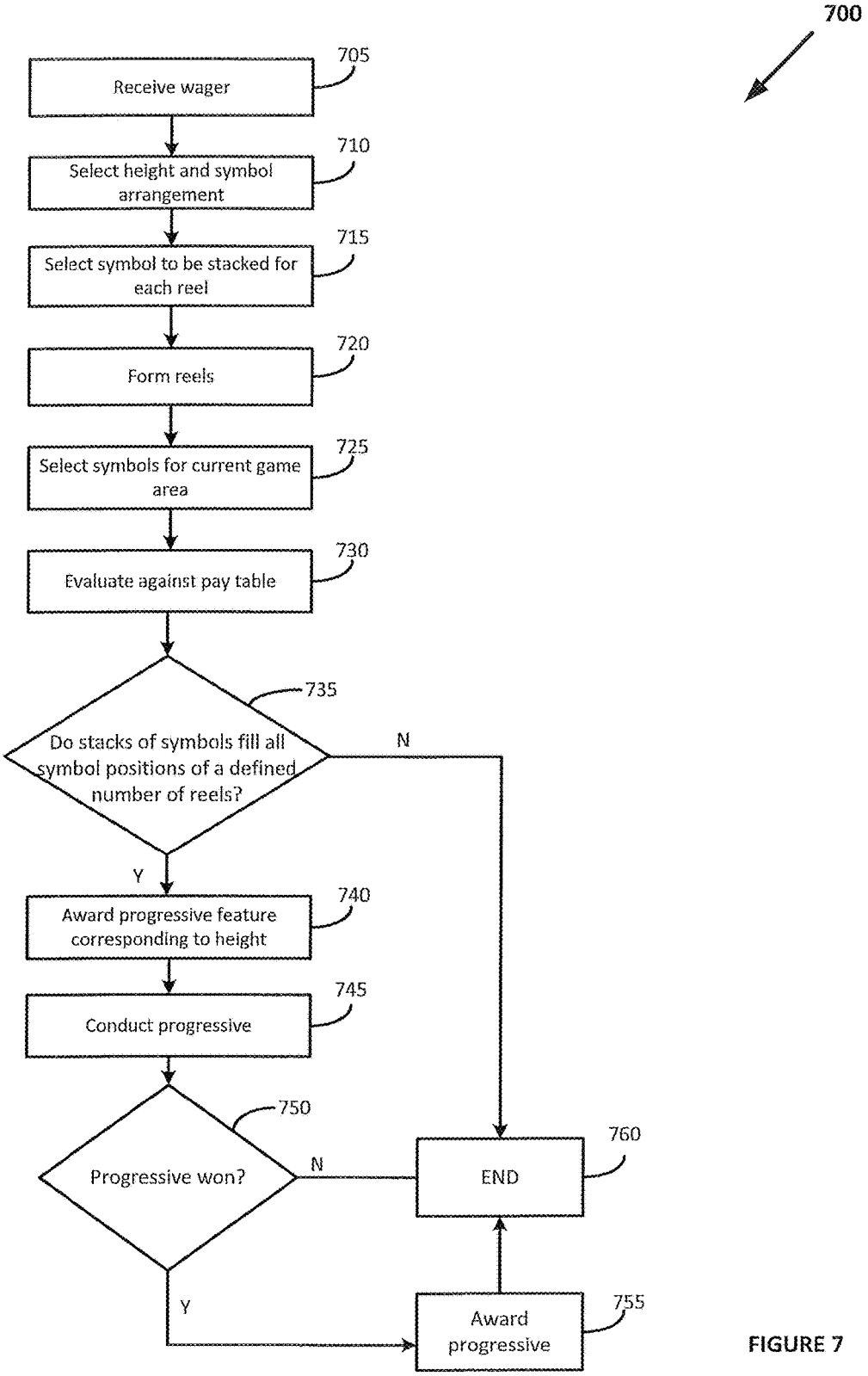
FIG. 7 is a flow chart of an embodiment.

Referring to FIG. 7, there is shown a method 700 of the embodiment. At step 705, a wager is received and a player initiates a play of the game. At step 710, a height-and-symbol arrangement is selected from a weighted table 642 of combinations of game area heights and stack length arrangements. An example table 901 of the table 642 is shown in FIG. 9. Four different reel heights (5 rows, 6 rows, 7 rows, 8 rows) are shown together with the number of stacks available for each reel height, i.e., sixteen different selections are available for random selection. However, each selection may be weighted. A reel height of five and number of stacks of six is shown with a weight of 1; whereas, a reel height of seven with three stacks is shown with a weight of 4. Thus, there is four times the chance of randomly selecting the reel height of seven and three stacks as there is in randomly selecting the reel height of five with six stacks. The weight column in table 901 has a weight associated with each of the 16 height/stack arrangements (although only two weights are shown in FIG. 9).

Referring again to FIG. 7, at step 715, a symbol is selected to be stacked for each reel. As shown in FIG. 10, a table 1001 illustrates ten different symbols 1003 that may be selected. Each symbol 1003 is associated with a single number 0 through 9 in a set 1005. A single number 0 through 9 is randomly selected for indicating its associated symbol 1003 for selection. In the embodiment, the selected symbol 1003 is the only symbol that occurs in each of the symbol stacks for one reel.

Referring again to FIG. 7, at step 720, the reels are formed. At step 725, the symbol selector 622B then selects the symbols for the game, e.g., by spinning and stopping the reels for display in the current game area.

At step 730, the outcome evaluator 623 evaluates the symbols selected at step 725 against the pay table. Also, evaluator 623 determines whether the stacks in the selected displayed symbols fill all symbol positions of a defined number of reels. For example, where three of the five reels only contain stacks, evaluator 623 may be configured to require one, two or three reels to only contain stacks. The outcome evaluator 623 awards the progressive feature from which the player may win the progressive corresponding to the current height, at step 740. The method then involves conducting the progressive feature game (e.g., a pick-a-box game where the player has a defined number of picks to find a jackpot awarding symbol) and upon the progressive being won, at step 750, the progressive prize is awarded at step 755. The method ends at step 760.

In some embodiments, an eligibility criterion may be applied in order for the player to be eligible for stacks of symbols to be added and/or for the game area to change height. For example, the player may be eligible based on the player making a certain sized wager, making an ante bet, selecting all win lines, playing sufficient games, or that the player is a member of a loyalty program.

Thus, at the start of each spin, the reels will be changed by inserting stacks of repeated symbols into the reels at semi-random points along the reels. It is a semi-random insertion in that the first position is randomly chosen and the following positions are chosen to maximize the distance between stacks on the reel. The lengths of these insertions are the same from reel to reel, but not from spin to spin. That is, at each spin the length of stacks is randomly selected. The symbols being inserted may also change from reel to reel and spin to spin.

The position of insertion, the symbols inserted, and number of occurrences of that symbol, are determined in three steps. Initially, the particular symbol to be inserted into each reel at the insertion point is randomly determined, for example using a table 1001 (FIG. 10). Next, the game height and the length of the stacks being inserted is randomly selected, for example, using table 901 (FIG. 9). The height and stack size are determined simultaneously by a single selection from a weighted table. In the embodiment, forty-eight symbols will always be inserted on a given reel and they will be: two stacks of 24, three stacks of 16, four stacks of 12 or six stacks of 8. Next, a random starting insertion point is determined on each reel. All points on the reel are equally likely to be determined. From the starting insertion point, the reel is divided into a number of approximately equal sections with said number being equal to the number of stacks determined to be inserted. For example, reel 1 has a length of 35 symbols. A random number between 0 and 34 (inclusive) is generated. For example, the number 11 is generated. Then, if 4 stacks of 12 symbols high were determined, then preferred insertion points would be: 11, 20, 29 and 2.

Next a check is performed to determine whether the insertion points are allowed. A stack of a given symbol cannot be inserted next to the same symbol. If, in our current example, the symbols to be inserted between points 11 and 12 match the base symbol located at point 12, the stack would be moved for insertion between points 10 and 11. If the symbols to be inserted between points 11 and 12 match the base symbol located at point 11, the stack would be moved for insertion between points 12 and 13. This adjustment does not change the preferred placement between points 20 and 21 for insertion at point 20, but this position, too, must be checked in the same manner so as not to insert the stack next to the same symbol.

Persons skilled in the art will appreciate that rather than a progressive feature game from which a progressive prize can be won, the filling of columns with stacks of symbols can be used to trigger some other form of feature game. A feature game involves some additional elements of game play which usually only occurs when a trigger condition is met (in this case based on stacks filling the game play area). Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game. Further, the progressive feature need not be the only feature game.

Typically, a winning outcome will result in some forms of awards being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

Example

In an example of an embodiment of the invention, the method of operating a gaming system involves:

1) Inserting stacks of varying length;

2) Varying the height of the game play area of varying height;

3) Requiring that the game area be filled with stacks to trigger the award of progressive jackpot prizes; and 4) Using the game height to both indicate and determine which Progressive is eligible.

In the example, the choice of symbols to be inserted onto the reels is made by the game controller using weighted tables of symbol combinations. In this way, the stacked symbols are placed into the game in a random manner. In one example, there are 35 fixed symbols on each reel. 48 symbols will be inserted into each of those reels to dynamically form the reel. By a random determination, they will be placed as one of the following: 2 stacks 24 symbols long, 3 stacks of 16 symbols, 4 stacks of 12 symbols, or 6 stacks of 8 symbols. Controlling the height of the stacks allows control of the probability of stopping the reel with the active game area filled with the same symbol. For example, for a game play area of height 8 symbol display positions (the maximum height of the game play area in this example), it is much less likely to fill with stacks of length 8 than it is with stacks of length 24. In this example, the weighted table is arranged such that different symbols of the symbols that can be stacked can be selected for each reel.

The gaming system indicates an "Active Progressive Level" by means of an "Active Game Height". Simply stated, the Active Game Height dictates the eligible progressive level for this spin of the base game. That is, there is a different progressive prize associated with each of the heights, with the highest progressive prize associated with the highest height and the lowest prize associated with the lowest height. Prior to the actual spin, all game heights and all levels of the Progressive are possible. In the example, after the start of the spin, if the game is only 5 symbol positions tall, only the lowest level of the 4 level Progressive is possible. Similarly, a 6 high game has the possibility of awarding the 2nd smallest progressive, and so forth for the next two levels.

The Progressive Feature is triggered (awarded) when the active game area of each reel (individually) is filled with the same symbol. That is, filling the active game area is a winning outcome that results in the award of the Feature. While in the example, the award is the conduct of a Progressive Feature which may or may not result in the award of the progressive prize, in other examples, an award (e.g. in credits) may be made directly in response to filling the active game area.

In the example, the active game area of each reel is individually filled in the sense that different symbols may fill each reel. To clarify, if the active game area of reel 1 is filled with symbol A, reel 2 filled with symbol B, reel 3 filled with symbol C, reel 4 filled with symbol D, and reel 5 filled with symbol E, the Progressive Feature tied to the current Game Height will be triggered. The symbols on reel 1 do not have to match those on reel 2. This is advantageous because in most stacking games, the player loses interest as soon as they see non-differing stacked symbols on reels 1 and 2, whereas in the present method the player can still achieve a win in this circumstances.

In the example, the Game Height and Stack Length are selected from a single, co-dependent weighted table. This is advantageous because if the stack length and the game height were determined independently, it would be necessary to greatly limit both the occurrences of long stacks and the increases in game height. By making it more likely that the largest game height and the shortest stacks appear together, it is possible to show more games of maximum height without over paying.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of conducting a game on an electronic gaming system that includes a player input mechanism, a game controller having a random number generator, a display, a set of reel strips each having a number of predefined symbols, and a credit input mechanism, the method comprising:

receiving, with the credit input mechanism of the electronic gaming system, a physical item associated with a monetary value to establish a credit balance;

receiving, via the player input mechanism, a wager on the game that is funded by the credit balance;

modifying, via the game controller, at least one of the reel strips by a) selecting, via the random number generator, one of a plurality of different arrangements of a defined number of stacked symbols, each arrangement dividing the defined number of stacked symbols into a different number of stacks, and b) adding the selected one arrangement to the predefined symbols of a respective one of the reel strips;

selecting symbols, via the random number generator, from the reel strips including the at least one modified reel strip;

displaying the selected symbols on the display; and making, via the game controller, an award of credits to the credit balance if the selected symbols include a winning outcome.

2. The method as claimed in claim 1, wherein modifying at least one of the reels strips further comprises randomly selecting a symbol for the selected one arrangement of stacked symbols.

3. The method as claimed in claim 2, wherein the randomly selecting the symbol is performed independently for each reel strip.

4. The method as claimed in claim 1, wherein modifying at least one of the reel strips further comprises modifying each reel strip.

5. The method as claimed in claim 4, wherein at least one winning outcome requires portions of an active game area corresponding to respective ones of a defined number of the reel strips to be filled by symbols of a stack of symbols.

6. The method as claimed in claim 5, wherein the defined number of reel strips is all of the reel strips.

7. The method as claimed in claim 1, further comprising selecting, via the game controller, a height for an active game area from one of a plurality of different heights of symbol display positions, and wherein selecting symbols further comprises selecting sufficient symbols to populate the active game area for the selected height.

8. The method as claimed in claim 7, and wherein at least some of the different heights are associated with different awards for filling portions of the active game area corresponding to respective ones of a defined number of the reel strips with symbols of a stack of symbols.

9. The method as claimed in claim 7, further comprising selecting the height of the active game area in conjunction with the randomly selecting one of a plurality of the different arrangements of the defined number of stacked symbols.

10. The method as claimed in claim 9, wherein the randomly selecting is performed via a weighted table that defines different combinations of arrangements of stacked symbols and heights of the active game area.

11. An electronic gaming system comprising:

a credit mechanism;

a player interface;

a display; and a game controller including a memory storing reel strips having predefined symbols, the game controller executing instructions which cause the game controller to at least:

in response to receipt of a physical item representing a monetary value, establish a credit balance based on the monetary value of the received physical item;

in response to an input received via the player interface, determine that the credit balance is sufficient for a wager of a selected wager amount;

in response to a player placing a wager on a game via the player interface:

modify at least one of the reel strips by conducting a random determination to select one of a plurality of different arrangements of a defined number of stacked symbols, each arrangement dividing the defined number of stacked symbols into a different number of stacks of the symbol, and adding the selected one arrangement to the predefined symbols of a respective one of the reel strips;

select symbols from the reel strips, including the at least one modified reel strip;

control the display to display the selected symbols; and make an award of credits to the credit balance if the selected symbols include a winning outcome.

12. An electronic game controller for a gaming system comprising a display, a credit mechanism, and a player interface, the electronic game controller comprising:

a memory storing a plurality of reel strips and a plurality of different arrangements of a defined number of stacked symbols, each reel strip having predefined symbols, each arrangement dividing the defined number of stacked symbols into a different number of stacks; and a processor having a random number generator, the processor executing instructions which cause the processor to:

in response to receipt of a physical item representing a monetary value, establish a credit balance based on the monetary value of the received physical item;

in response to an input received via the player interface, determine that the credit balance is sufficient for a wager of a selected wager amount;

in response to a player placing a wager on a game via the player interface, modify at least one of the reel strips by conducting via the random number generator a random determination to select one of the plurality of different arrangements of a defined number of stacked symbols, and adding the selected arrangement to the predefined symbols for a respective reel strip;

select symbols from the reel strips including the at least one modified reel strip;

control the display to display the selected symbols; and make an award of credits to the credit balance if the selected symbols include one or more winning outcomes.

13. A method of conducting a game on an electronic gaming system comprising a game controller having a random number generator, a display, a credit mechanism, and a player input mechanism, the method comprising:

receiving, with the credit mechanism of the electronic gaming system, a physical item associated with a monetary value and establishing a credit balance;

receiving, via the player input mechanism, a wager on the game that is funded by the credit balance;

selecting, using the game controller, a height for an active game area from one of a plurality of different heights, wherein each height corresponds to a defined number of symbol display positions, wherein at least some of the different heights are associated with different awards;

selecting, via the random number generator, symbols from a plurality of reel strips to populate the active game area for the selected height, each reel strip comprising at least one stack of symbols, each symbol of a respective stack being the same;

displaying the selected symbols in the active game area on the display; and making, using the game controller, an award associated with the selected height when portions of the active game area corresponding to respective ones of a defined number of the reel strips are filled by symbols of a stack of symbols.

14. The method as claimed in claim 13, wherein the defined number of reel strips is all of the reel strips.

15. The method as claimed in claim 13, wherein each stack has a length that corresponds to a defined number of symbol display positions, and wherein each reel strip comprises at least one stack of symbols that is a length in symbol positions that equals a highest possible height of the active game area.

16. The method as claimed in claim 15, wherein the lengths of the stacks of symbols are dynamically selected from a set of possible lengths.

17. The method as claimed in claim 16, wherein a smallest possible length of the stacks of symbols corresponds to the highest possible height of the active game area.

18. The method as claimed in claim 16, further comprising selecting lengths of the stacks of symbols and the height of the active game area from a weighted table that defines different combinations of lengths of stacked symbols and heights of the active game area.

19. An electronic gaming system comprising:

a credit mechanism;

a player interface;

a display; and a game controller executing instructions which cause the game controller to at least:

in response to receipt of a physical item representing a monetary value, establish a credit balance based on the monetary value of the received physical item;

in response to an input received via the player interface, determine that the credit balance is sufficient for a wager of a selected wager amount;

in response to a player placing a wager on a game via the player interface, select a height for an active game area from one of a plurality of different heights of symbol display positions, wherein at least some of the different heights are associated with different credit awards;

select symbols from a plurality of reel strips to populate the active game area for the selected height, each reel strip comprising at least one stack of symbols, each symbol of a respective stack being identical;

control the display to display the selected symbols in the active game area; and make the credit award associated with the selected height to the credit balance when portions of the active game area corresponding to respective ones of a defined number of the reel strips are filled by symbols of a stack of symbols.

20. An electronic game controller for a gaming system comprising a display, a credit mechanism, and a player interface, the electronic game controller comprising:

a memory storing a plurality of different heights for an active game area, each height corresponding to a number of rows of display positions on the display, the memory further storing a plurality of reel strips, each reel strip including a plurality of defined symbols and at least one stack of symbols, each symbol of a respective stack being identical;

a processor having a random number generator, the processor executing instructions which cause the processor to:

select a height for the active game area from the plurality of different heights for the active game area, wherein at least some of the different heights are associated with different awards;

select symbols from the plurality of the reel strips via the random number generator to populate the active game area for the selected height;

control the display to display the selected symbols in the active game area; and make an award associated with the selected height when portions of the active game area corresponding to respective ones of a defined number of the reel strips are filled by symbols of a stack of symbols.

* * * * *